US011813857B2

(12) United States Patent
Takahashi et al.

(10) Patent No.: US 11,813,857 B2
(45) Date of Patent: Nov. 14, 2023

(54) CONTROL SYSTEM, AND MEDIUM

(71) Applicant: BROTHER KOGYO KABUSHIKI KAISHA, Nagoya (JP)

(72) Inventors: Eisuke Takahashi, Nagoya (JP); Sachie Kiriyama, Toyoake (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/678,618

(22) Filed: Feb. 23, 2022

(65) Prior Publication Data

US 2022/0266612 A1 Aug. 25, 2022

(30) Foreign Application Priority Data

Feb. 24, 2021 (JP) ..... 2021-027593

(51) Int. Cl.
*B41J 19/20* (2006.01)
*B41J 25/00* (2006.01)

(52) U.S. Cl.
CPC ..... *B41J 19/202* (2013.01); *B41J 25/005* (2013.01); *B41J 19/207* (2013.01)

(58) Field of Classification Search
CPC ..... B41J 19/202; B41J 25/005; B41J 19/207
See application file for complete search history.

(56) References Cited

U.S. PATENT DOCUMENTS 6,442,111 B1 * 8/2002 Takahashi ..... G11B 7/08541 369/53.3
2005/0189895 A1 * 9/2005 Muroi ..... B41J 19/202 318/379
2010/0123751 A1 * 5/2010 Lesaki ..... B41J 19/202 347/16
2017/0217230 A1 * 8/2017 Yokozawa ..... H04N 1/047

FOREIGN PATENT DOCUMENTS

JP 2010-120252 A 6/2010
JP 2012218304 A * 11/2012 ..... B41J 19/00
JP 2017-136828 A 8/2017

* cited by examiner

*Primary Examiner* — Yaovi M Ameh
(74) *Attorney, Agent, or Firm* — Merchant & Gould P.C.

(57) ABSTRACT

There is provided control system including: movement mechanism configured so that the movement mechanism is driven by motor; detector configured to detect position and speed of the movable member; and controller. The controller is configured to: control the motor so that the movement mechanism reciprocatively moves the movable member; and in a course to move the movable member to a returning point, control the movement of the movable member by controlling the motor based on the speed of the movable member so that the movable member is moved at a constant speed until a deceleration start point of time, and control the movement of the movable member by controlling the motor based on the position of the movable member so that the movable member is decelerated from the deceleration start point of time and stops at the returning point in accordance with a target position locus.

13 Claims, 14 Drawing Sheets

CONTROL SYSTEM, AND MEDIUM

CROSS REFERENCE TO RELATED APPLICATIONS

The present application claims priority from Japanese Patent Application No. 2021-027593, filed on Feb. 24, 2021, the disclosure of which is incorporated herein by reference in its entirety.

BACKGROUND

The present disclosure relates to a control system, and a medium.

A technique has been already known in relation to the serial printer, in which the speed control is performed so that a carriage is decelerated from a first point disposed upstream from a target stop position, and the movement control of the carriage is switched to the position control at a second point disposed downstream from the first point.

SUMMARY

A control system according to an aspect of the present disclosure comprises a movement mechanism, a detector, and a controller. The movement mechanism is configured so that the movement mechanism is driven by a motor to move a movable member. The detector is configured to detect a position and a speed (velocity) of the movable member. The controller is configured to control movement of the movable member by controlling the motor based on the position and the speed of the movable member detected by the detector.

According to the aspect of the present disclosure, the controller is configured to:

control the motor so that the movement mechanism reciprocatively moves the movable member; and in a course to move the movable member to a returning point, control the movement of the movable member by controlling the motor based on the speed of the movable member so that the movable member is moved at a constant speed until a deceleration start point of time before the movable member arrives at the returning point, and control the movement of the movable member by controlling the motor based on the position of the movable member so that the movable member is decelerated from the deceleration start point of time and stops at the returning point in accordance with a target position locus.

Owing to the speed control performed for the constant speed movement, the amount of change of the speed of the movable member is small during the constant speed movement of the movable member just before the deceleration start point of time as compared with during the deceleration movement of the movable member. Therefore, when the movement control is switched from the speed control to the position control from the deceleration start point of time, the influence, which is exerted by the change of the speed of the movable member provided just before on the position control to be performed immediately after the switching, is decreased as compared with when the switching is performed after the deceleration start point of time. Therefore, according to the aspect of the present disclosure, the switching from the speed control to the position control can be appropriately executed in the system for moving the movable member as compared with the conventional technique.

According to another aspect of the present disclosure, a medium may be provided. The medium may be a non-transitory and computer-readable medium stored with a program executable by a control system; the control system including a movement mechanism configured so that the movement mechanism is driven by a motor to move a movable member; a detector configured to detect a position and a speed of the movable member; and a controller configured to control movement of the movable member by controlling the motor based on the position and the speed of the movable member detected by the detector.

The program may be configured to cause the controller to:

control the motor so that the movement mechanism reciprocatively moves the movable member; and in a course to move the movable member to a returning point, control the movement of the movable member by controlling the motor based on the speed of the movable member so that the movable member is moved at a constant speed until a deceleration start point of time before the movable member arrives at the returning point, and control the movement of the movable member by controlling the motor based on the position of the movable member so that the movable member is decelerated from the deceleration start point of time and stops at the returning point in accordance with a target position locus.

DETAILED DESCRIPTION

The reason, why the movement control is switched between the speed control and the position control in the serial printer such as described in Japanese Patent Application Laid-open No. 2010-120252, is that it is necessary to highly accurately control the speed (velocity) of the carriage during the image formation on a sheet in order to control the landing points of an ink discharged (ejected, jetted) from a recording head. The reason, why the position control is executed, is that it is intended to accurately stop the carriage at the target stop position corresponding to the next movement start point so that the next movement control is accurately realized. However, in the case of the conventional method, the behavior of the carriage tends to be unstable immediately after the switching to the position control.

In view of the above, according to the aspect of the present disclosure, it is desirable to successfully provide a technique which makes it possible to appropriately execute the switching from the speed control to the position control as compared with the conventional technique in the movement control of a movable member.

Exemplary embodiments of the present disclosure will be explained below with reference to the drawings.

First Embodiment

Figure 1:
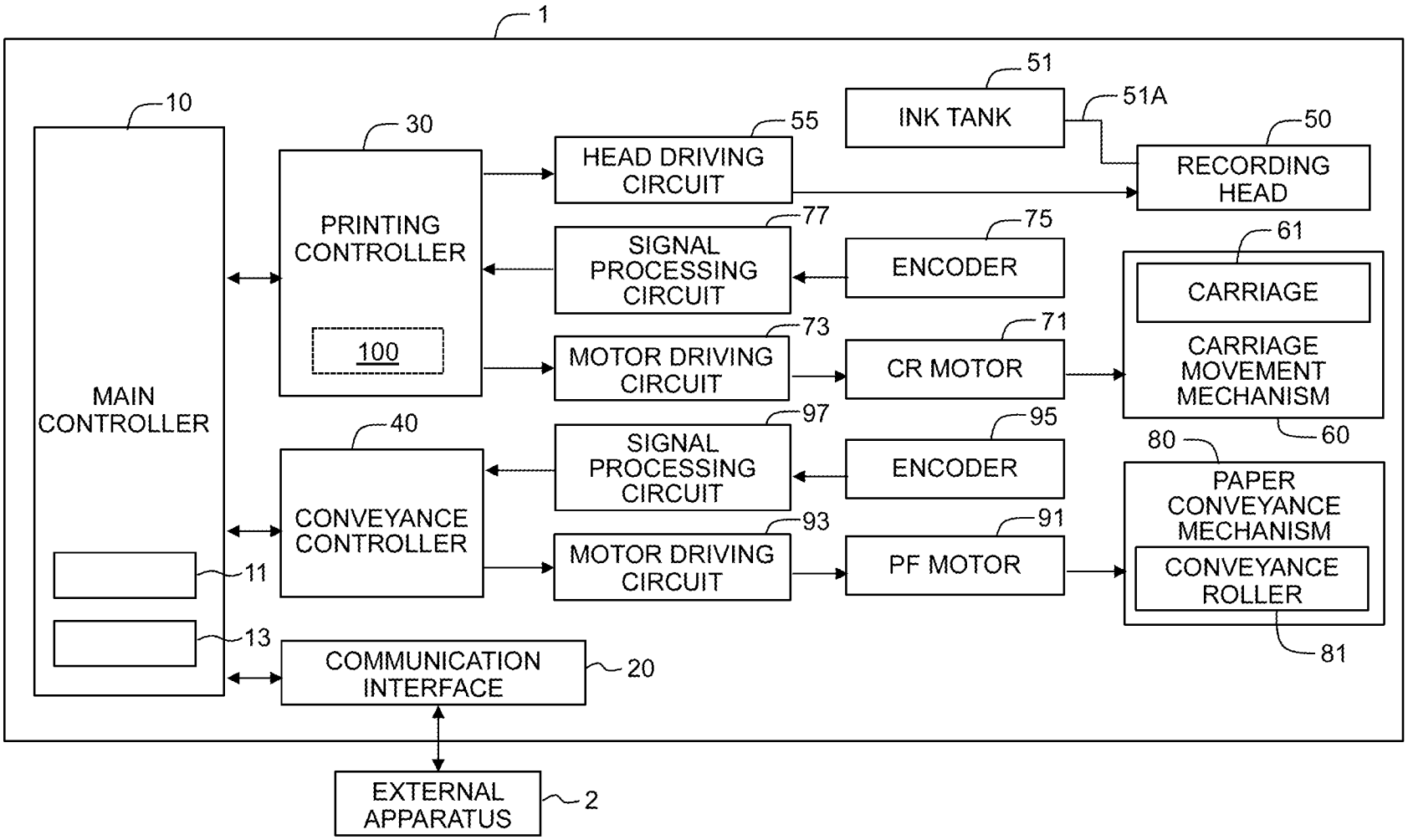
FIG. 1 is a block diagram illustrative of configuration of an image forming system.

An image forming system 1 of this embodiment depicted in FIG. 1 is configured as an ink-jet printer provided with a main controller 10, a communication interface 20, a printing controller 30, and a conveyance controller 40.

The main controller 10 is provided with a processor 11 and a memory (storage) 13. The memory 13 includes an unillustrated nonvolatile memory, and the memory 13 stores computer programs. The processor 11 controls the image forming system 1 in an integrated manner by executing the process in accordance with the computer program stored in the memory 13. It is allowable to understand that the process, which is executed by the main controller 10 as explained below, is realized by the processor 11 by executing the process in accordance with the computer program.

If the main controller 10 receives the image data of the printing object from an external apparatus 2 via the communication interface 20, the main controller 10 executes the process to form, on the paper (paper sheet) Q, the image based on the received image data in cooperation with the printing controller 30 and the conveyance controller 40. Each of the printing controller 30 and the conveyance controller 40 may be configured, for example, by an exclusive circuit such as ASIC (Application Specific Integrated Circuit) or the like.

The image forming system 1 further comprises a recording head 50, an ink tank 51, a head driving circuit 55, a carriage movement mechanism 60, a CR motor 71, a motor driving circuit 73, an encoder 75, and a signal processing circuit 77. The carriage movement mechanism 60 is provided with a carriage 61 which carries the recording head 50.

The printing controller 30 controls the CR motor 71 in accordance with the command supplied from the main controller 10. Accordingly, the printing controller 30 controls the movement of the carriage 61 to be moved by the carriage movement mechanism 60. Further, the printing controller 30 controls the ink discharging (jetting) action performed by the recording head 50. In accordance with this control, the printing controller 30 forms the image on the paper Q.

The recording head 50 is a discharging head for discharging the ink toward the paper Q. The recording head 50 is a so-called ink-jet head. The recording head 50 is connected to an ink tank 51 which is not carried on the carriage 61, via a tube 51A. The recording head 50 receives the supply of the ink from the ink tank 51 via the tube 51A, and the recording head 50 discharges liquid droplets of the ink.

The head driving circuit 55 is configured so that the recording head 50 is driven in accordance with the control signal supplied from the printing controller 30. The carriage movement mechanism 60 is driven by the CR motor 71. The carriage movement mechanism 60 is configured so that the motive power is transmitted from the CR motor 71 to the carriage 61, and thus the carriage 61 is reciprocatively moved in the main scanning direction. Detailed configuration of the carriage movement mechanism 60 will be described later on with reference to FIG. 2.

The CR motor 71 is configured by a DC motor. The motor driving circuit 73 is configured so that the CR motor 71 is driven by supplying, to the CR motor 71, the driving electric power corresponding to the operation amount U inputted from the printing controller 30. Specifically, the motor driving circuit 73 drives the CR motor 71 with the driving current correspond to the operation amount U.

The encoder 75 is a linear encoder which outputs the encoder signal depending on the displacement of the carriage 61 in the main scanning direction. The signal processing circuit 77 detects the position X and the speed (velocity) V of the carriage 61 in the main scanning direction on the basis of the encoder signal inputted from the encoder 75. The speed V is detected, for example, as a reciprocal of the time interval between the two adjoining rising edges or falling edges of the encoder signal. The position X and the speed V of the carriage 61, which are detected by the signal processing circuit 77, are inputted into the printing controller 30.

The printing controller 30 determines the operation amount U for the CR motor 71 to control the CR motor 71 on the basis of the position X and the speed V of the carriage 61 inputted from the signal processing circuit 77 so that the movement control of the carriage 61 is realized in accordance with the command from the main controller 10.

Specifically, the control of the CR motor 71 is realized by a motor controller 100 provided for the printing controller 30. Detailed configuration of the motor controller 100 will be described later on with reference to FIG. 4 to FIG. 6.

Further, the printing controller 30 inputs, into the head driving circuit 55, the control signal to realize the ink discharging control in accordance with the command from the main controller 10 on the basis of the position X of the carriage 61 inputted from the signal processing circuit 77. Accordingly, the ink is discharged from the recording head 50 onto the paper Q in order to form the image of the printing object on the paper Q.

The conveyance controller 40 controls the conveyance of the paper Q by controlling a PF motor 91 in accordance with the command supplied from the main controller 10. The image forming system 1 further comprises, as constitutive elements relevant to the conveyance of the paper Q, a paper conveyance mechanism 80, the PF motor 91, a motor driving circuit 93, an encoder 95, and a signal processing circuit 97.

The paper conveyance mechanism 80 is provided with a conveyance roller 81. The paper conveyance mechanism 80 receives the motive power from the PF motor 91 to rotate the conveyance roller 81. Thus, the paper conveyance mechanism 80 conveys the paper Q in the sub scanning direction orthogonal to the main scanning direction. Accordingly, the paper conveyance mechanism 80 feeds the paper Q in the sub scanning direction in conformity with the action of the recording head 50.

The PF motor 91 is configured by a DC motor. The motor driving circuit 93 applies, to the PF motor 91, the driving current in accordance with the operation amount inputted from the conveyance controller 40 so that the PF motor 91 is driven. The encoder 95 is a rotary encoder which is arranged on a rotation shaft of the PF motor 91 or the conveyance roller 81 to output the encoder signal in accordance with the rotation of the PF motor 91 or the conveyance roller 81.

The signal processing circuit 97 detects the rotation amount and the rotation speed of the conveyance roller 81 on the basis of the encoder signal inputted from the encoder 95. The rotation amount and the rotation speed, which are detected by the signal processing circuit 97, are inputted into the conveyance controller 40. The conveyance controller 40 determines the operation amount for the PF motor 91 to control the PF motor 91 on the basis of the rotation amount and the rotation speed inputted from the signal processing circuit 97. Accordingly, the conveyance controller 40 controls the conveyance of the paper Q performed by the conveyance roller 81.

Figure 2:
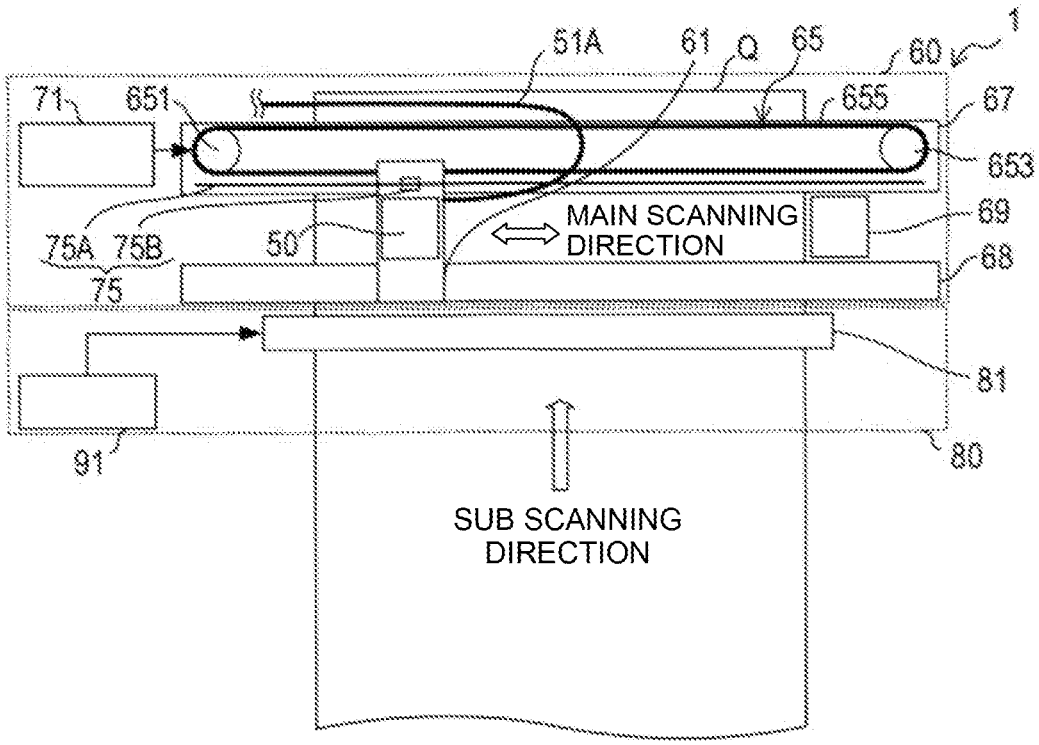
FIG. 2 is a drawing illustrative of configuration of a carriage movement mechanism and a paper conveying mechanism.

As depicted in FIG. 2, the carriage movement mechanism 60 is provided with a belt mechanism 65 and guide rails 67, 68 in addition to the carriage 61. The belt mechanism 65 is provided with a driving pulley 651 and a driven pulley 653 which are arranged in the main scanning direction, and a belt 655 which is wound between the driving pulley 651 and the driven pulley 653.

The carriage 61 is fixed to the belt 655. In the belt mechanism 65, the driving pulley 651 receives the motive power supplied from the CR motor 71, and the driving pulley 651 is rotated. The belt 655 and the driven pulley 653 are driven and rotated in accordance with the rotation of the driving pulley 651.

The guide rails 67, 68 are provided to extend in the main scanning direction. The guide rails 67, 68 are arranged at mutually separated positions in the sub scanning direction. The belt mechanism 65 is arranged on the guide rail 67. Protruding walls (not depicted), which extend, for example, in the main scanning direction, are formed on the guide rails 67, 68 in order to regulate the movement direction of the carriage 61 in the main scanning direction (i.e., in order to prohibit the carriage 61 from moving in the sub scanning direction).

The carriage 61 is moved and displaced in the main scanning direction on the guide rails 67, 68 while being interlocked with the rotation of the belt 655, while being regulated by the guide rails 67, 68 in relation to the movement direction. The recording head 50 is moved in the main scanning direction in accordance with the movement of the carriage 61.

The encoder 75 is provided with an encoder scale 75A and an optical sensor 75B. The encoder scale 75A is arranged on the guide rail 67 in the main scanning direction. The optical sensor 75B is carried on the carriage 61. The encoder 75 inputs, into the signal processing circuit 77, the encoder signal depending on the change of the relative position between the encoder scale 75A and the optical sensor 75B.

The conveyance roller 81 is arranged in parallel to the main scanning direction at an upstream position from the recording head 50 in the sub scanning direction. The conveyance roller 81 receives the motive power from the PF motor 91, and the conveyance roller 81 is rotated. The paper Q, which is conveyed from the upstream, is conveyed thereby to the downstream in the sub scanning direction.

Subsequently, an explanation will be made with reference to FIG. 3 about details of the printing control process executed by the main controller 10 when the image data of the printing object is received. The printing controller 30 and the conveyance controller 40 perform the movement control of the carriage 61, the discharging control of the ink, and the conveyance control of the paper Q on the basis of the command supplied from the main controller 10 in the printing control process.

When the printing control process is started, the main controller 10 executes the cueing process for the paper Q (S110). In the cueing process, the main controller 10 inputs the command into the conveyance controller 40 so that the paper Q is conveyed in the sub scanning direction by the aid of the paper conveyance mechanism 80 until the position at which the head of the printing object area on the paper Q arrives at the position disposed under or below the recording head 50.

Further, the carriage 61, which is positioned at the home position (details will be described later on), is moved to the start point by the main controller 10 (S120). The start point may be the point which is separated upstream by a predetermined distance from the head in the main scanning direction of the printing object area on the paper Q.

After that, the main controller 10 executes the image forming process in order to realize the image forming action corresponding to one pass (S130). The "image forming action corresponding to one pass" referred to herein intends the action to form the image on the paper Q by moving the carriage 61 one way to the returning point in the main scanning direction and allowing the recording head 50 to discharge the ink during the course of movement.

As well-known, in the case of the ink-jet printer, the image, which is based on the image data of the printing object, is formed on the entire paper Q by repeating the image forming action corresponding to one pass and the conveying action for conveying the paper Q in the sub scanning direction.

In the image forming process, the main controller 10 commands the printing controller 30 to perform the movement control of the carriage 61 until arrival at the target stop position in accordance with the speed profile by inputting the speed profile and the target stop position into the printing controller 30.

The speed profile corresponds to the target speed locus Pv until the returning point, and the speed profile represents the locus of the speed command value Vr corresponding to the target speed at each point of time until the carriage 61 stops. The speed profile may be either the time series data of the speed command value Vr or the time function for defining the speed command value Vr.

The acceleration profile, which represents the acceleration command value Ar at each point of time, corresponding to the first-grade time differentiation of the speed command value Vr, may be further inputted into the printing controller 30, and the jerk profile, which represents the jerk command value Yr at each point of time, corresponding to the first-grade time differentiation of the acceleration command value Ar, may be further inputted into the printing controller 30.

The main controller 10 further inputs, into the printing controller 30, the image data to be formed on the paper Q during the course of movement of the carriage 61 in the main scanning direction in accordance with the movement control, and the main controller 10 commands the printing controller 30 to perform the ink discharging control in accordance with the image data.

Accordingly, the main controller 10 allows the printing controller 30 to execute the movement control of the carriage 61 and the ink discharging control in synchronization therewith in order to realize the image forming action corresponding to one pass described above.

If the image forming action corresponding to one pass in accordance with the image forming process in S130 is terminated, the main controller 10 determines whether or not the image forming action is completed for one page of the paper (S140). In this procedure, if it is determined that the image forming action corresponding to one page is not completed (No in S140), the main controller 10 executes the paper conveyance (feeding) process (S150).

In the paper conveyance process, the main controller 10 allows the conveyance controller 40 to execute the conveyance control of the paper Q in order to convey the paper Q downstream by a predetermined distance in the sub scanning direction in accordance with the command input into the conveyance controller 40. The predetermined distance referred to herein corresponds to the length in the sub scanning direction of the image to be formed on the paper Q in accordance with the "image forming action for one pass" in S130.

If the process in S150 is terminated, the main controller 10 returns the process to S130 to execute the image forming process in which the movement direction of the carriage 61 is set to the opposite direction. In the image forming process, the main controller 10 commands the printing controller 30 to perform the movement control of the carriage 61 in order that the carriage 61, which stops at the returning point in accordance with the previous image forming process, is moved to the next returning point, and the ink discharging control to be executed in the course thereof.

In S140, if it is determined that the image forming action is completed for one page of the paper, the main controller 10 executes the paper discharge process (S180). In the paper discharge process, the main controller 10 allows the conveyance controller 40 to execute the conveyance control of the paper Q for discharging the paper Q to an undepicted paper discharge tray by the aid of the paper conveyance mechanism 80 in accordance with the input of the command into the conveyance controller 40.

Further, the main controller 10 determines whether or not the image data of the next page is present (S190). If it is determined that the image data of the next page is present (Yes in S190), then the main controller 10 returns the process to S110 to execute the cueing process for the paper Q, and the main controller 10 executes a series of the processes (S120 to S150, S180) for the paper Q subjected to the cueing. Thus, the main controller 10 executes the image formation of the next page in the same manner as described above.

If it is determined in S190 that the image data of the next page is absent (No in 190), the main controller 10 allows the printing controller 30 to execute the movement control of the carriage 61 to the home position (S200) in accordance with the input of the command into the printing controller 30. In this way, the carriage 61 is moved to the home position. After that, the main controller 10 terminates the printing control process.

Figure 4:
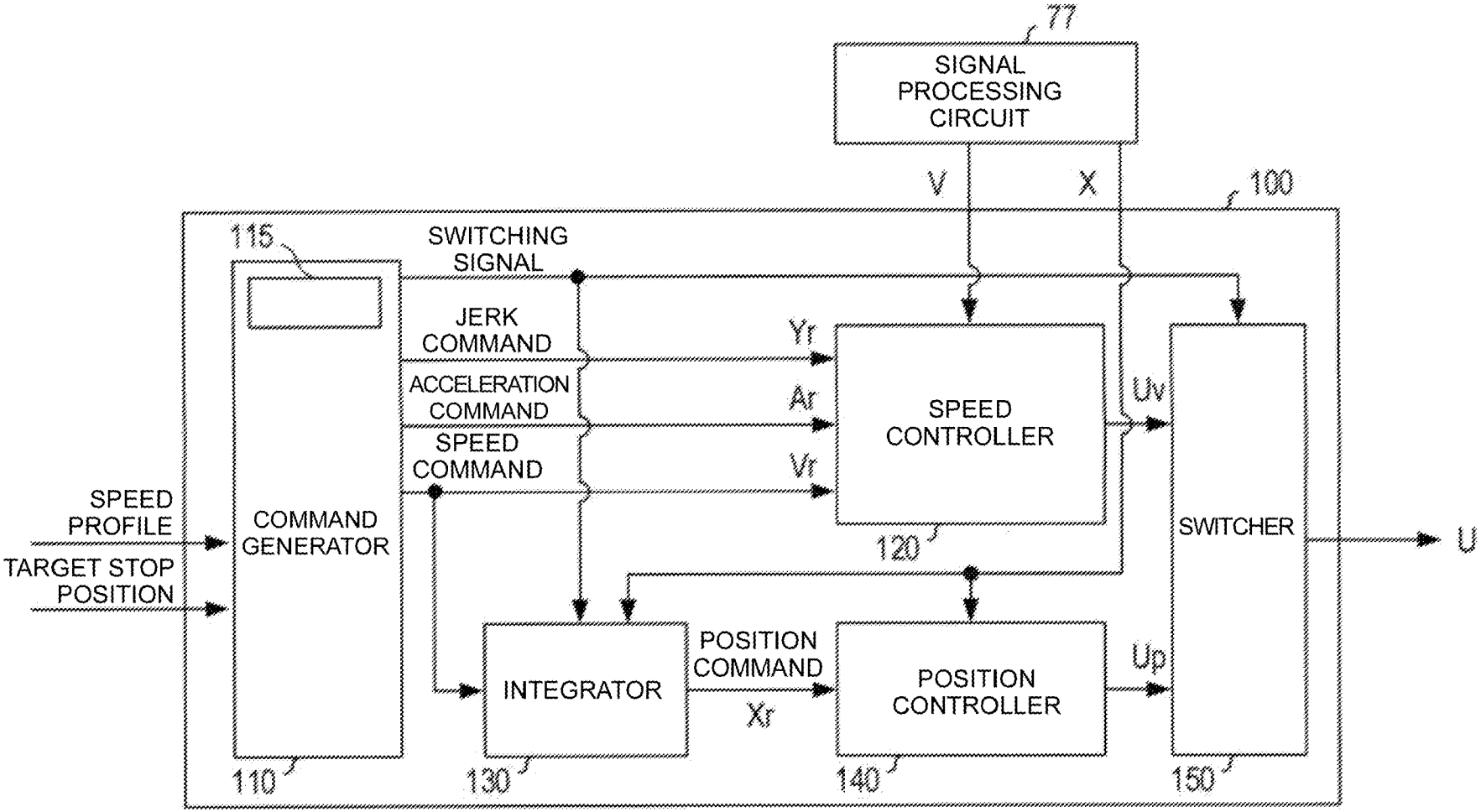
FIG. 4 is a drawing illustrative of configuration of a motor controller.

Subsequently, an explanation will be made about the configuration of the motor controller 100 provided for the printing controller 30 to be operated by receiving the command from the main controller 10. As depicted in FIG. 4, the motor controller 100 is provided with a command generator 110, a speed controller 120, an integrator 130, a position controller 140, and a switcher 150.

The command generator 110 is configured to output the speed command value Vr, the acceleration command value Ar, and the jerk command value Yr for designating the speed, the acceleration, and the jerk of the carriage 61 to be realized in accordance with the speed profile, respectively. The speed command value Vr, the acceleration command value Ar, and the jerk command value Yr are outputted from the command generator 110 at time intervals corresponding to the control cycle.

The acceleration command value Ar corresponds to the first-grade time differentiation of the speed command value Vr, and the jerk command value Yr corresponds to the first-grade time differentiation of the acceleration command value Ar. The acceleration command value Ar and the jerk command value Yr may be outputted in accordance with the acceleration profile and the jerk profile provided from the main controller 10 respectively.

The speed controller 120 calculates the operation amount Uv for moving the carriage 61 at the speed, the acceleration, and the jerk corresponding to the command values Vr, Ar, Yr, on the basis of the speed V of the carriage 61 detected by the signal processing circuit 77, and the speed command value Vr, the acceleration command value Ar, and the jerk command value Yr inputted from the command generator 110, and the speed controller 120 outputs the calculated operation amount Uv.

The integrator 130 is configured to output the position command value Xr calculated by performing the time integration of the speed command value Vr inputted from the command generator 110. The position controller 140 calculates the operation amount Up for controlling the carriage 61 to the position corresponding to the position command value Xr on the basis of the position command value Xr inputted from the integrator 130, and the position controller 140 outputs the calculated operation amount Up.

The switcher 150 is configured to selectively output, as the operation amount U for the CR motor 71, one of the operation amount Uv from the speed controller 120 and the operation amount Up from the position controller 140 in accordance with the switching signal supplied from the command generator 110.

Specifically, if the switching signal is the OFF signal, the switcher 150 selectively outputs the operation amount Uv from the speed controller 120 as the operation amount U. If the switching signal is the ON signal, the switcher 150 selectively outputs the operation amount Up from the position controller 140 as the operation amount U.

The operation amount U corresponds to the output of the motor controller 100, and the operation amount U may be a current command value to designate the driving current to be applied to the CR motor 71. The motor controller 100 switches the operation amount U to be outputted between the operation amount Uv from the speed controller 120 and the operation amount Up from the position controller 140 in accordance with the switching signal described above. Accordingly, the motor controller 100 switches and executes the speed control and the position control to realize the highly accurate movement control of the carriage 61.

Figure 5A:
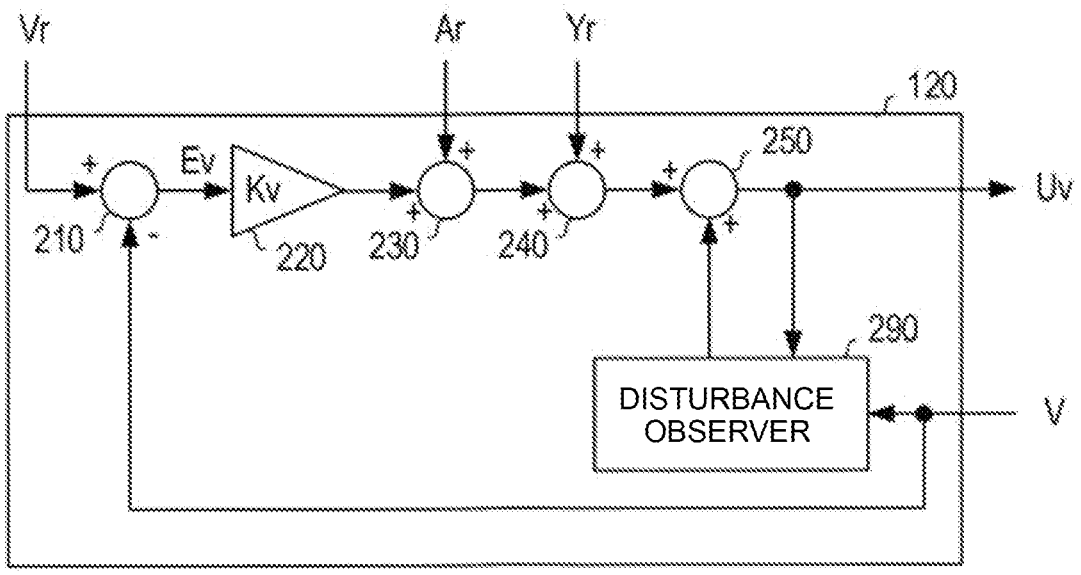
FIG. 5A is a block diagram illustrative of configuration of a speed controller.

The speed controller 120 exemplified in FIG. 5A is provided with a subtracter 210, a gain amplifier 220, adders 230, 240, 250, and a disturbance observer 290. The subtracter 210 outputs the deviation Ev=Vr−V between the speed command value Vr and the detected speed V of the carriage 61. The deviation Ev is amplified by a gain Kv by the gain amplifier 220, and then the deviation Ev is outputted from the gain amplifier 220.

The output Kv·Ev of the gain amplifier 220 passes through the adders 230, 240, and the output is converted into the operation amount (Kv·Ev+Ar+Yr) obtained by adding the acceleration command value Ar and the jerk command value Yr. Further, in the adder 250, the operation amount (Kv·Ev+Ar+Yr) is added to the disturbance estimated value d calculated by the disturbance observer 290. The operation amount (Kv·Ev+Ar+Yr+d) after the addition is outputted as the operation amount Uv described above from the speed controller 120.

Figure 5B:
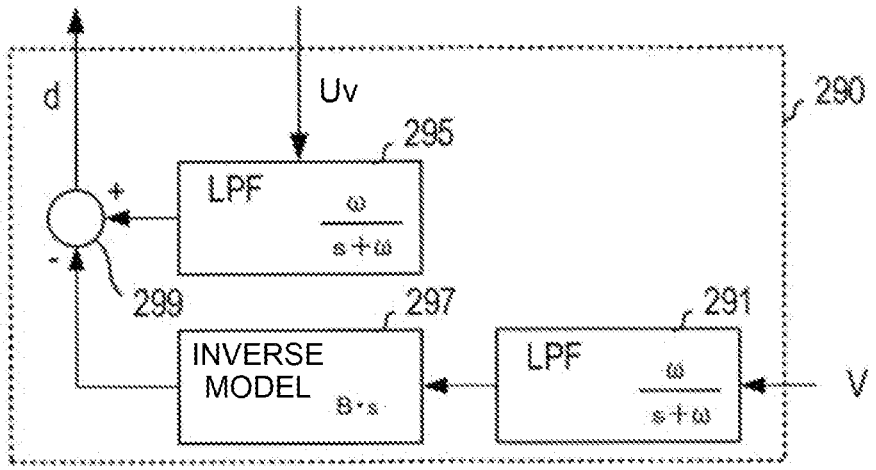
FIG. 5B is a block diagram illustrative of a disturbance observer.

As exemplified in FIG. 5B, the disturbance observer 290 is provided with low pass filters 291, 295, an inverse model 297, and a subtracter 299. The low pass filter 291 removes the high frequency component from the speed V of the carriage 61 detected by the signal processing circuit 77 on the basis of the encoder signal, and the speed V from which the high frequency component has been removed is inputted into the inverse model 297. The inverse model 297 calculates the corresponding operation amount U* on the basis of the speed V from which the high frequency component has been removed, and inputs the calculated operation amount U* into the subtracter 299.

The inverse model 297 is the calculation model which is represented by the transfer function H−1 to fulfill the expression u=H−1y if the control output y for the control input u is represented by the expression y=Hu by using the transfer function H. According to this embodiment, the control input u is the operation amount U described above, and the control output y is the speed V of the carriage 61. The motion of the control object based on the use of the CR motor 71 can be represented by the rigid model. In this case, the inverse model is H−1=B·s (provided that s represents the Laplace operator).

The low pass filter 295 removes the high frequency component from the operation amount Uv which is the output of the speed controller 120. The operation amount Uv from which the high frequency component has been removed is inputted into the subtracter 299. The subtracter 299 subtracts the operation amount U* which is the output of the inverse model 297 from the operation amount Uv. Thus, the subtracter 299 calculates the disturbance estimated value d=Uv−U* which is inputted into the adder 250.

Accordingly, the speed controller 120 calculates the operation amount Uv in which the disturbance is considered for realizing the movement control of the carriage 61 in accordance with the speed command value Vr. The operation amount Uv is inputted into the switcher 150.

Figure 6:
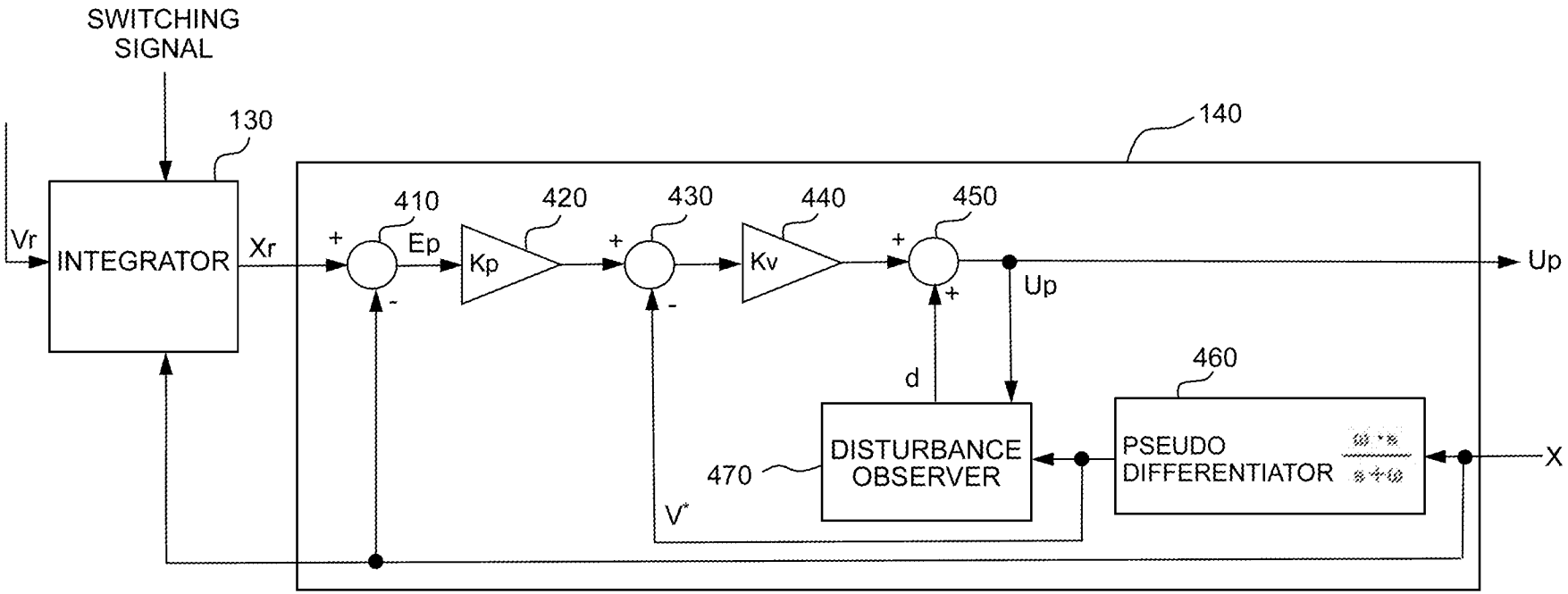
FIG. 6 is a block diagram illustrative of configuration of a position controller.

On the other hand, the position controller 140 exemplified in FIG. 6 is provided with subtracters 410, 430, gain amplifiers 420, 440, an adder 450, a pseudo differentiator 460, and an disturbance observer 470.

The pseudo differentiator 460 corresponds to the high pass filter, and the pseudo differentiator 460 pseudo-differentiates the position X of the carriage 61 detected by the signal processing circuit 77 to provide the output as the estimated speed V*. The pseudo differentiator 460 may be configured so that the pseudo differentiator 460 outputs, as the estimated speed V*, the speed V detected on the basis of the encoder signal or the speed command value Vr, if there is no past data of the position X required for the pseudo differentiation at the initial stage after the start of the position control.

The disturbance observer 470 is configured in the same manner as the disturbance observer 290 of the speed controller 120 (see FIG. 5B). The disturbance observer 470 calculates the disturbance estimated value d=Up−H−1V* which is inputted into the adder 450 by using the estimated speed V* outputted from the pseudo differentiator 460 in place of the speed V detected by the signal processing circuit 77 and using the operation amount Up as the output of the position controller 140 in place of the operation amount Uv.

The subtracter 410 outputs the deviation Ep=Xr−X between the position command value Xr inputted from the integrator 130 and the detected position X of the carriage 61. The deviation Ep is amplified by the gain Kp by the gain amplifier 420.

The subtracter 430 subtracts the estimated speed V* from the output Kp·Ep of the gain amplifier 420 to provide the output. The output of the subtracter 430 (Kp·Ep−V*) is inputted into the gain amplifier 440. The gain amplifier 440 amplifies the output of the subtracter 430 (Kp√Ep−V*) by the gain Kv.

The adder 450 adds the output Kv(Kp·Ep−V*) of the gain amplifier 440 to the disturbance estimated value d to provide the output. The output of the adder 450 {Kv(Kp·Ep−V*)+d} is outputted as the operation amount Up described above from the position controller 140. Accordingly, the position controller 140 calculates the operation amount Up in which the disturbance is considered for realizing the movement of the carriage 61 in accordance with the position command value Xr. The operation amount Up is inputted into the switcher 150.

Further, the position command value Xr is generated by the integrator 130 as follows. The switching signal is inputted into the integrator 130 from the command generator 110. The integrator 130 is operated at the point of time at which the switching signal is switched from the OFF signal to the ON signal such that the initial value of the position command value Xr is set to the position X of the carriage 61 detected by the signal processing circuit 77 at that point of time, and the integrator 130 outputs the initial value. That is, the present position of the carriage 61, which is provided at the start of the position control, is outputted as the initial value of the position command value Xr.

After that, the integrator 130 repeats the integrating action for the speed command value Vr until the position command value Xr arrives at the target stop position. The value, which is obtained by adding the integrated value of the speed command value Vr to the initial value described above, is outputted as the position command value Xr. The integrator 130 is operated so that the target stop position is outputted as the position command value Xr at or after the arrival of the position command value Xr at the target stop position.

The switching of the switching signal between the ON signal and the OFF signal is realized by a switching controller 115 provided for the command generator 110. The switching controller 115 is configured to switch the switching signal to be outputted from the command generator 110 by executing the switching control process depicted in FIG. 7A.

Figure 7A:
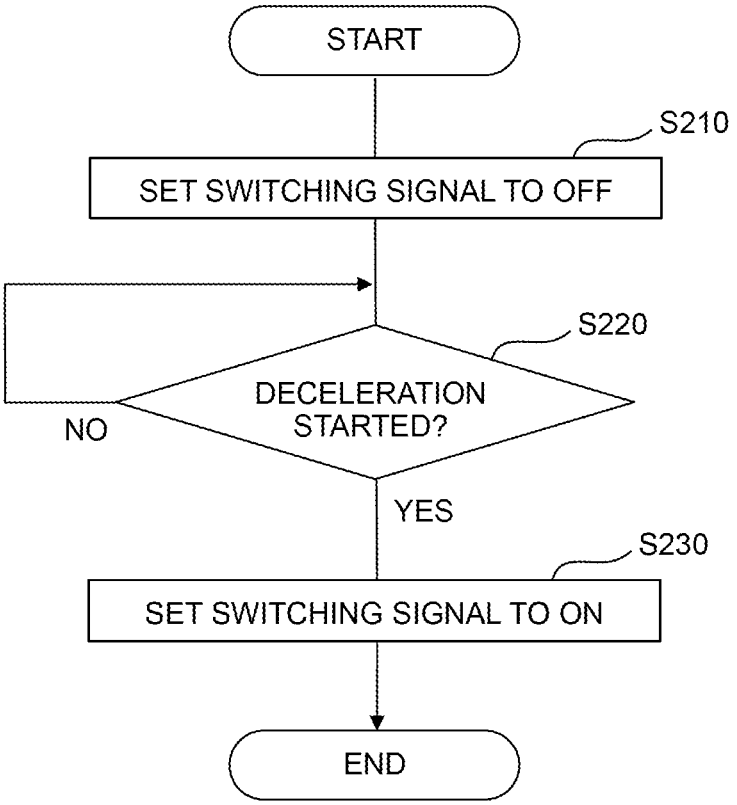
FIG. 7A is a flow chart illustrative of a switching control process executed by a switching controller.

The switching controller 115 starts the switching control process depicted in FIG. 7A at the stage at which the motor controller 100 receives the command from the main controller 10 and the motor controller 100 intends to start the new movement control of the carriage 61 in accordance with the speed profile. The switching signal is set to the OFF signal (S210).

Accordingly, at the point of time at which the movement control is started for the carriage 61, the OFF signal is outputted as the switching signal from the command generator 110, and the operation amount Uv supplied from the speed controller 120 is outputted as the operation amount U for the CR motor 71 from the switcher 150.

After that, the switching controller 115 waits until arrival of the deceleration start timing specified from the speed profile (S220). If the deceleration start timing arrives (Yes in S220), the switching signal is set to the ON signal. After that, the switching control process is terminated.

In accordance with the setting in 5230, the operation amount Up, which is outputted from the position controller 140, is outputted as the operation amount U for the CR motor 71 from the switcher 150 at or after the deceleration start point of time of the carriage 61.

Figure 7B:
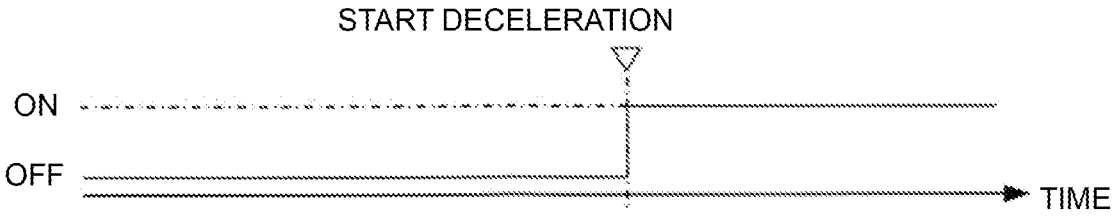
FIG. 7B is a drawing illustrative of the time-dependent change of a switching signal.

That is, as depicted in FIG. 7B, the switching signal is inputted into the switcher 150 as the OFF signal until the deceleration start point of time specified from the speed profile, and the switching signal is inputted into the switcher 150 as the ON signal at or after the deceleration start point of time.

Based on the switching signal, the switcher 150 switches and outputs the operation amount Uv supplied from the speed controller 120 and the operation amount Up supplied from the position controller 140 as the operation amount U for the CR motor 71. Accordingly, as depicted in FIG. 8, the movement control of the carriage 61 is switched from the speed control to the position control at the deceleration start point of time.

That is, the motor controller 100 controls the speed V of the carriage 61 by controlling the CR motor 71 with the operation amount Uv based on the deviation Ev=Vr−V between the speed command value Vr corresponding to the target speed locus Pv and the detected speed V of the carriage 61 before the deceleration start point of time. The locus of the speed command value Vr as the target speed locus Pv is exemplified by a thick line in a graph of time versus speed depicted in the upper part of FIG. 8.

The motor controller 100 controls the position X of the carriage 61 by controlling the CR motor 71 with the operation amount Up based on the deviation Ep=Xr−X between the position command value Xr corresponding to the integration of the target speed locus Pv and the detected position X of the carriage 61 at or after the deceleration start point of time. In accordance with the position control based on the position command value Xr, the carriage 61 is subjected to the deceleration control so that the carriage 61 stops at the target stop position corresponding to the returning point. The locus of the position command value Xr as the target position locus Px is depicted by a thick line in a graph of time versus position depicted in the lower part of FIG. 8. The target position locus Px corresponds to the integration of the target speed locus Pv.

Figure 8:
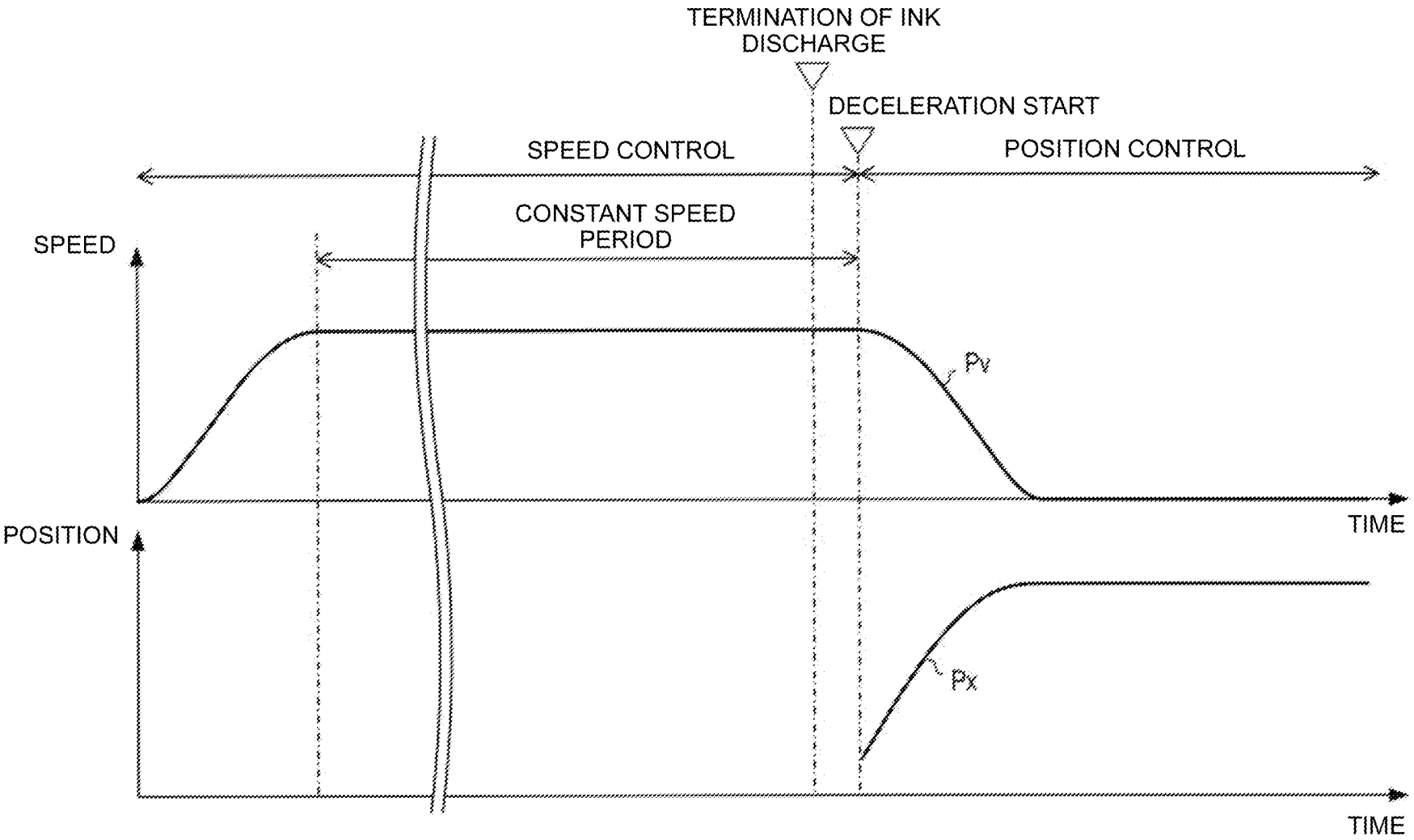
FIG. 8 is a drawing to explain the switching from the speed control to the position control.

The target speed locus Pv depicted in FIG. 8 includes the acceleration period (interval, or section), the constant speed period, the deceleration period, and the stop period. The target speed locus Pv is set by the main controller 10 so that the image formation period, in which the ink is discharged from the recording head 50, is positioned in the constant speed period in the image forming action corresponding to one pass. The corresponding speed profile is inputted into the motor controller 100 from the main controller 10.

The reason, why the discharging of the ink is limited to the constant speed period, is that it is intended to highly accurately control the landing point on the paper Q of the ink discharged from the recording head 50. In order to control the landing point highly accurately, it is necessary to highly accurately control the speed of the carriage 61. On this account, the movement control of the carriage 61 is performed in accordance with the speed control so that the carriage 61 is moved at the constant speed accurately in the constant speed period.

On the other hand, when the carriage 61 stops at the returning point, the next movement control of the carriage 61 is performed from the stop point. Therefore, it is preferable that the carriage 61 stops correctly at the target stop position. On this account, in this embodiment, the movement control of the carriage 61 is performed in accordance with the position control before and after the carriage 61 stops at the returning point.

In particular, in this embodiment, the tube 51A for supplying the ink is connected to the recording head 50. The load, which acts on the carriage 61, is not uniform on account of the curvature of the tube 51A accompanied by the movement of the carriage 61.

If the carriage 61 is moved to the returning point while continuing the speed control, there is such a possibility that the carriage 61 may stop or move backward before the target stop position due to the high load raised by the curvature. According to this embodiment, the influence to deteriorate the stop accuracy, which is caused by the fluctuation of the load as described above, is suppressed by executing the position control, and the carriage 61 is stopped and retained at the target stop position highly accurately.

The position control, which is performed by the position controller 140, is continued until the next movement control is started for the carriage 61 even after the carriage 61 arrives at the target stop position so that the stop period is included in FIG. 8. Accordingly, a phenomenon, in which the carriage 61 is moved backward from the target stop position after the carriage 61 stops at the target stop position, is suppressed from being caused.

The motor controller 100 switches the movement control of the carriage 61 from the speed control to the position control at the point of time of the termination of the constant speed period in which the movement control of the carriage 61 is stable, in other words at the point of time of the deceleration start. According to this switching, it is possible to suppress the unstable behavior of the carriage 61 at the initial stage of the switching to the position control, as compared with the case in which the switching is performed after the start of the deceleration. That is, owing to the speed control in the constant speed period, the speed change amount of the carriage 61, in other words, the control error relevant to the speed is small immediately before the deceleration start as compared with after the deceleration start. Therefore, in a case that the movement control is switched from the speed control to the position control at the deceleration start point of time, the influence, which is exerted on the position control immediately after the switching by the change of the speed of the carriage 61 immediately before the switching, is decreased as compared with a case in which the movement control is switched after the deceleration start point of time. Therefore, according to this embodiment, it is possible to appropriately execute the switching from the speed control to the position control as compared with the conventional technique.

In particular, according to this embodiment, in order to suppress the unstable behavior upon the switching from the speed control to the position control, the target position locus Px is set on the basis of the integration of the target speed locus Pv, and the initial value of the target position is set to the detected present position of the carriage 61.

Therefore, according to this embodiment, it is possible to perform the highly accurate movement control as a whole in relation to the reciprocative movement of the carriage 61. Owing to the realization of the highly accurate movement control, the discharging control of the ink, especially the control of the landing point is realized highly accurately, and the quality of the image formed on the paper Q is improved.

The speed control and the position control, which are based on the use of the speed controller 120 and the position controller 140 described above, are executed in the process of the reciprocative movement of the carriage 61 accompanied with the image formation. When the movement control of the carriage 61 is performed until arrival at the home position on the basis of the command from the main controller 10 (S200), the minute movement control, which is distinct from the control as described above, is executed.

Figure 9A:
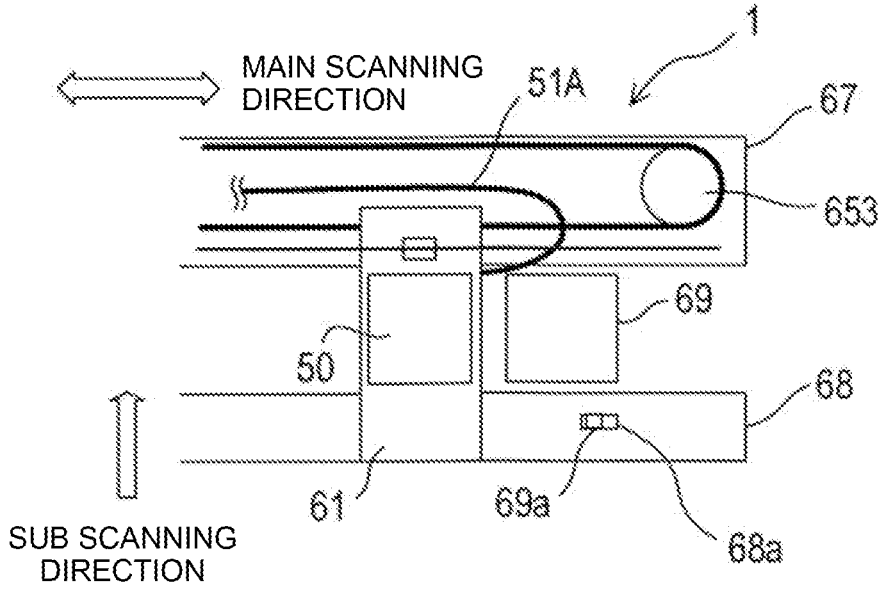
FIG. 9A is a drawing to explain the arrangement of a capping mechanism.

In the image forming system 1, as depicted in FIG. 9A, a capping mechanism 69 is provided at the home position. The home position is positioned at the outside of the area in which the carriage 61 is reciprocatively movable during the image formation, in the movable range of the carriage 61 in the main scanning direction.

The capping mechanism 69 is mechanically connected to a lever 69*a* which protrudes upwardly from a through-hole 68*a* provided on the guide rail 68. The capping mechanism 69 is configured so that an unillustrated cap is lifted up upwardly while being interlocked with the movement of the lever 69*a*.

When the carriage 61 approaches the home position, then the lever 69*a* receives the pressing force exerted from the carriage 61, and the lever 69*a* is moved in the direction to lift up the cap. The cap is lifted up to the uppermost position so that the cap covers the nozzle surface of the recording head 50 in a state in which the carriage 61 is arranged at the home position.

The minute movement control is performed in order to suppress the nozzle surface from being injured. The nozzle surface would be otherwise injured such that the nozzle surface of the recording head 50 slides while making contact with the cap immediately before the carriage 61 stops at the home position.

In the movement process of the carriage 61 to the home position, the movement control of the carriage 61 is performed in accordance with the speed control until the carriage 61 arrives at the start point of the minute movement control disposed upstream from the home position by a predetermined distance. The speed control is realized, for example, by using the speed controller 120. When the carriage 61 arrives at the start point of the minute movement control, the minute movement control is executed.

Figure 9B:
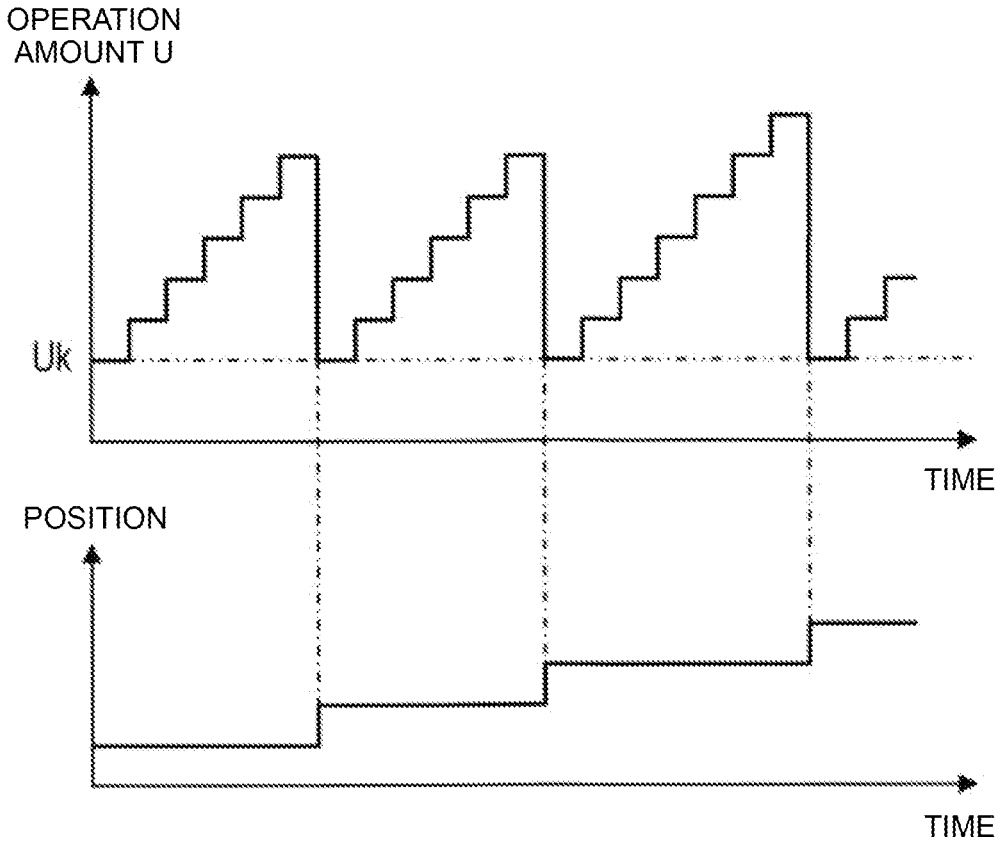
FIG. 9B is a graph to explain the change of the operation amount brought about by the minute movement control together with the position change of the carriage.

As depicted in FIG. 9B, the minute movement control is the control in which the carriage 61 is minutely moved to the home position by repeating such an action that the operation amount U for the CR motor 71 is gradually raised from the reference value Uk, the operation amount U is lowered to return the operation amount U to the reference value Uk if the position X of the carriage 61, which is detected by the signal processing circuit 77, is changed by a unit amount frontwardly in the course, and the operation amount U is gradually raised again. The unit amount corresponds to the minimum unit of the position X of the carriage 61 capable of being detected by the signal processing circuit 77.

The upper part of FIG. 9B depicts a situation in which the operation amount U is gradually increased in a stepwise manner in accordance with the minute movement control, in a graph having the horizontal axis which shows the time and the vertical axis which shows the operation amount U. The lower part of FIG. 9B shows the position change of the carriage 61 in a graph having the horizontal axis which is the same time axis as that of the upper part of FIG. 9B and having the vertical axis which shows the position of the carriage 61.

The minute movement control described above, which can be referred to as "special position control", may be realized, for example, such that the position controller 140 executes the calculating action for calculating the operation amount U based on the minute movement control described above, in place of the calculation of the operation amount Up based on the deviation Ep between the position command value Xr and the detected position X, from the start point of the minute movement control. It is allowable to understand that the start point of the minute movement control is positioned on the home position side as compared with the deceleration start point.

In this way, the image forming system 1 of this embodiment switches and executes the speed control and the position control in order to accurately stop the carriage 61 at the target stop position corresponding to the returning point when the carriage 61 is reciprocatively moved in order to form the image on the paper Q. Further, the minute movement control is executed during the movement control of the carriage 61 to arrive at the home position. Thus, the carriage 61 is moved in a manner that the nozzle surface of the recording head 50 is protected. Therefore, according to this embodiment, it is possible to appropriately move the carriage 61.

It is significant that the technique according to this embodiment is applied especially to a UV ink-jet printer provided with a hard tube. In the case of the UV ink-jet printer, an ink, which is curable by being irradiated with the ultraviolet ray (UV), is used. Therefore, the tube, which has an ability to shut off the ultraviolet ray, is used for the tube for supplying the ink, i.e., the tube 51A depicted in FIG. 1, FIG. 2, and FIG. 9A. Such a tube is harder than the tube which has no ability to cut off the ultraviolet ray.

According to the technique of this embodiment, even when the large load acts on the carriage 61 due to the curvature of the hard tube 51A, it is possible to stop and maintain the carriage 61 highly accurately at the target stop position by switching the movement control from the speed control to the position control as described above.

Second Embodiment

Subsequently, an image forming system 1 according to a second embodiment will be explained. However, the greater part of the image forming system 1 of the second embodiment is configured in the same manner as the first embodiment. In the following description, constitutive components of the image forming system 1 of the second embodiment, which are different from those of the first embodiment, will be selectively explained. The constitutive components same as those of the first embodiment will be omitted from the explanation. It is allowable to understand that the constitutive components, which are affixed with the same reference numerals as those of the first embodiment, are the same as the corresponding constitutive components of the first embodiment, unless any additional explanation is made.

In the image forming system 1 of this embodiment, the ink discharging action may be executed even in the deceleration period for the carriage 61. The speed profile, in which the image formation period continues to not only the constant speed period but also a part of the deceleration period, may be inputted into the printing controller 30.

Figure 10:
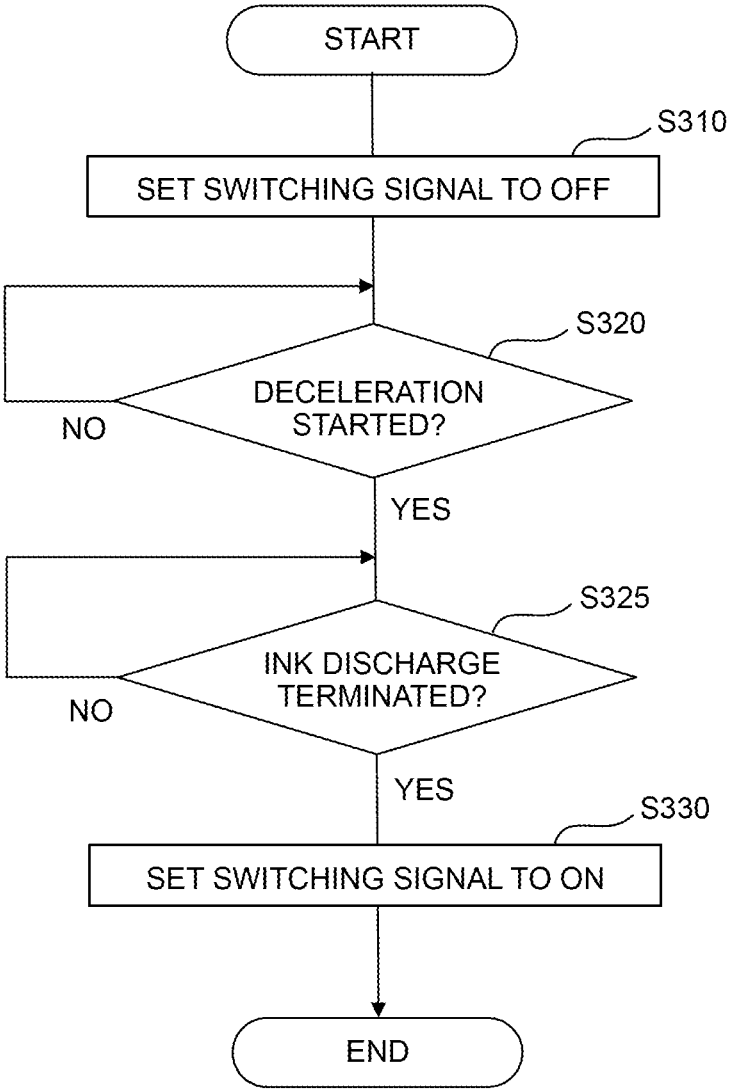
FIG. 10 is a flow chart illustrative of a switching control process.

In order to control the landing point of the ink discharged in the deceleration period, the switching controller 115 executes a switching control process depicted in FIG. 10 in place of the process depicted in FIG. 7A. The switching controller 115 starts the switching control process depicted in FIG. 10 so that the switching signal is set to the OFF signal (S310) at the stage at which the motor controller 100 receives the command from the main controller 10 and the motor controller 100 intends to start the new movement control for the carriage 61 in accordance with the speed profile.

After that, the switching controller 115 waits until arrival of the deceleration start timing specified from the speed profile (S320). At the deceleration start timing (Yes in S320), the switching controller 115 determines whether or not the ink discharging action in the course of movement to the present returning point has been terminated at the present point of time (S325).

If the discharging action has been terminated by the deceleration start timing (Yes in S325), the switching controller 115 sets the switching signal to the ON signal at the deceleration start timing (S330). If the discharging action has not been terminated by the deceleration start timing, then the switching controller 115 waits until the discharging action is terminated (No in S325), and the switching controller 115 sets the switching signal to the ON signal (S330) at the timing at which the discharging action is terminated (Yes in S325). After that, the switching control process is terminated.

In such a switching, if the ink discharging action is terminated before the deceleration start timing, the operation amount U for the CR motor 71 is switched from the operation amount Uv of the speed controller 120 to the operation amount Up of the position controller 140 at the deceleration start timing in the same manner as the first embodiment. That is, the movement control of the carriage 61 is switched from the speed control to the position control at the deceleration start timing.

On the other hand, if the ink discharging action has not been terminated by the deceleration start timing, the operation amount U for the CR motor 71 is switched from the operation amount Uv of the speed controller 120 to the operation amount Up of the position controller 140 at the termination timing of the ink discharging action. That is, the movement control of the carriage 61 is switched from the speed control to the position control at the termination timing of the discharging action as depicted in FIG. 11.

Figure 11:
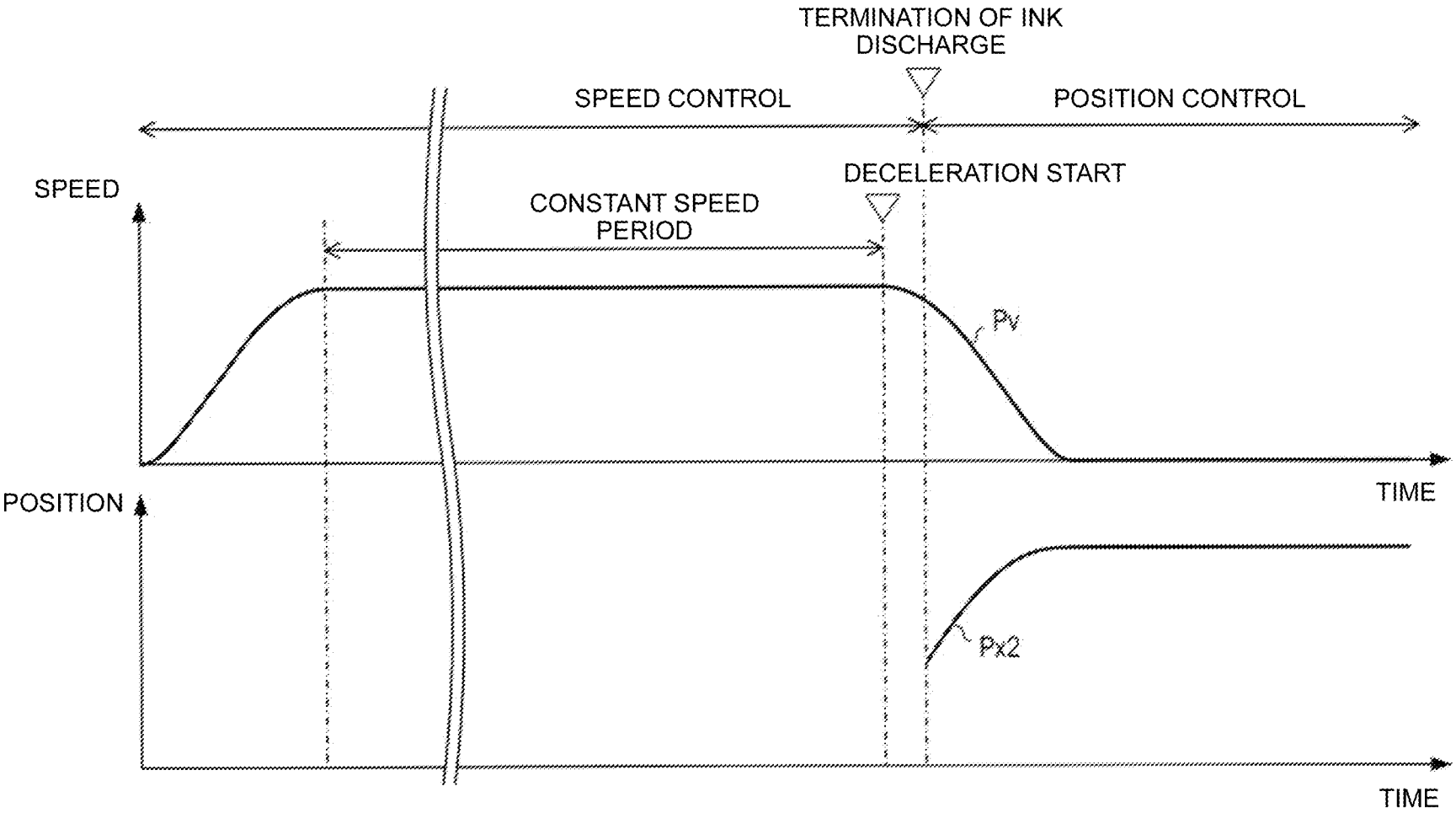
FIG. 11 is a drawing to explain the switching from the speed control to the position control.

A graph depicted in FIG. 11 shows the target speed locus Pv and the target position locus Px2 of the second embodiment corresponding to the graph depicted in FIG. 8. As understandable from FIG. 11, the integrating action performed by the integrator 130 is started from the termination timing of the discharging action at which the switching signal is switched from the OFF signal to the ON signal. The position command value Xr is calculated as the integration of the target speed locus Pv in which the position X of the carriage 61 detected by the signal processing circuit 77 at the termination timing is used as the initial value. The position command value Xr is inputted into the position controller 140.

According to this embodiment, even when the deceleration is started, then the motor controller 100 maintains the speed control for the movement control for the carriage 61 until the termination of the image formation period at which the ink discharging action is terminated, and the motor controller 100 does not switch the movement control to the position control. The image forming system 1 may be configured so that the ink is discharged in the deceleration period of the carriage 61, for example, for the purpose of miniaturization. However, according to this embodiment, it is possible to suppress the deterioration of the quality of the image formed on the paper Q in the deceleration period.

Third Embodiment

Subsequently, an image forming system 1 according to a third embodiment will be explained. However, the greater part of the image forming system 1 of the third embodiment is configured in the same manner as the first embodiment. In the following description, constitutive components of the image forming system 1 of the third embodiment, which are different from those of the first embodiment, will be selectively explained. The constitutive components same as those of the first embodiment will be omitted from the explanation. It is allowable to understand that the constitutive components, which are affixed with the same reference numerals as those of the first embodiment, are the same as the corresponding constitutive components of the first embodiment, unless any additional explanation is made.

In the image forming system 1 of this embodiment, the image formation is performed on the paper Q by discharging the ink in only the outward route of the outward route and the homeward route of the carriage 61 which is reciprocatively movable. The image formation is not performed on the paper Q in the homeward route.

Figure 3:
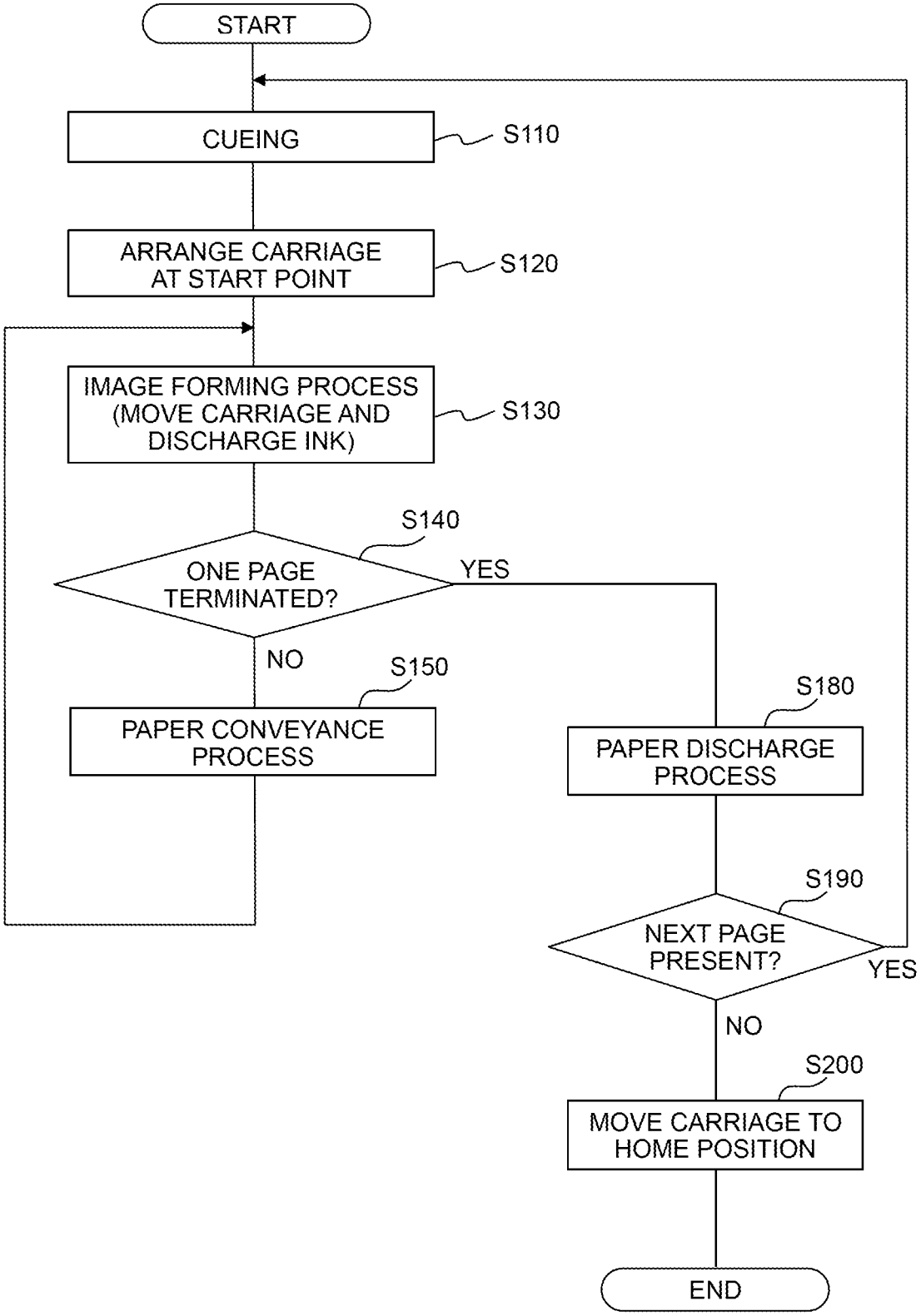
FIG. 3 is a flow chart illustrative of a printing control process executed by a main controller.
Figure 12:
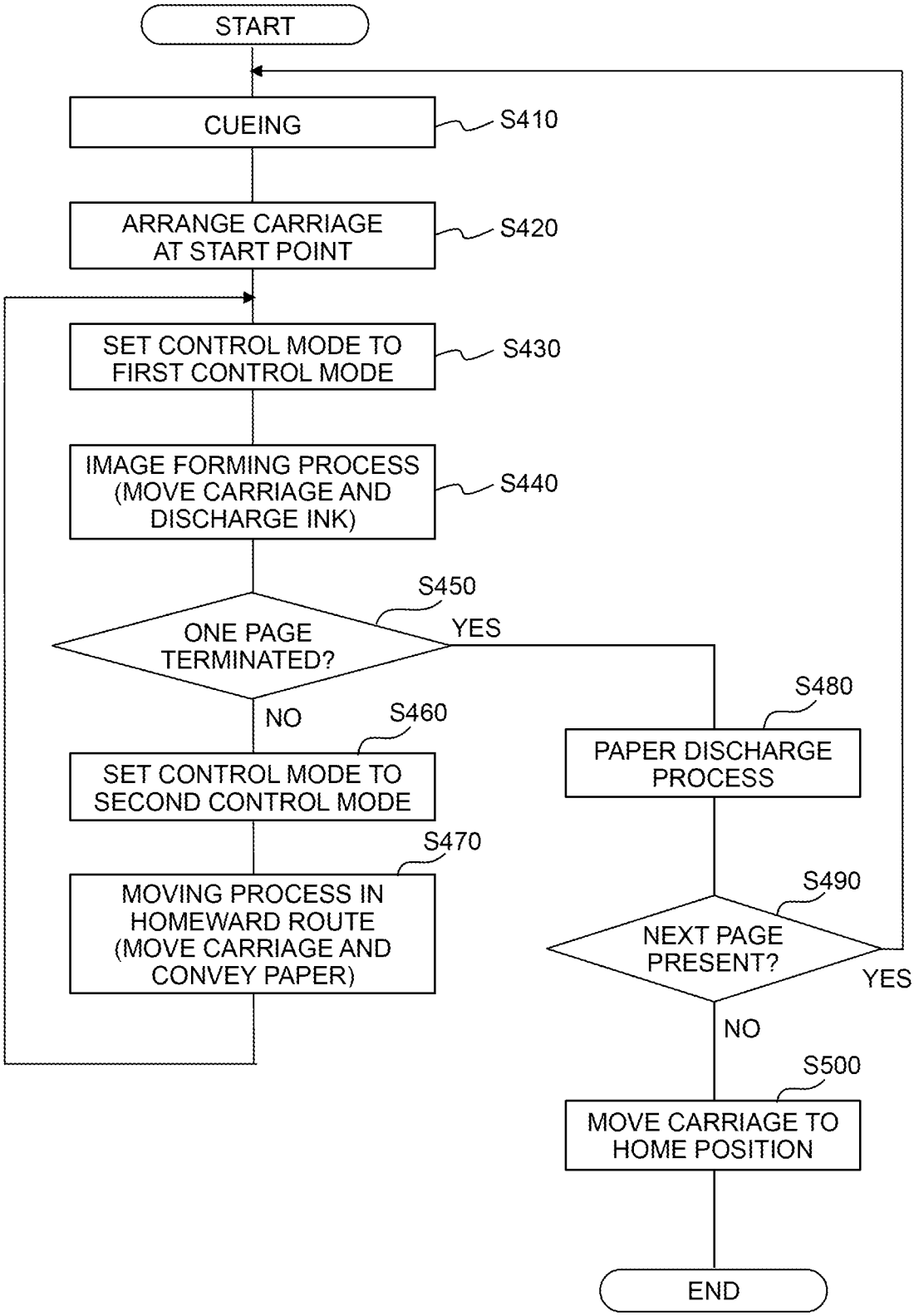
FIG. 12 is a flow chart illustrative of a printing control process.

When the main controller 10 receives the image data of the printing object, the main controller 10 starts the printing control process depicted in FIG. 12 in place of the printing control process depicted in FIG. 3. When the printing control process is started, the main controller 10 executes the cueing process for the paper Q (S410) in the same manner as the processes of S110 and S120 so that the carriage 61 is moved to the start point (S420).

After that, the main controller 10 sets the control mode of the printing controller 30 to the first control mode (S430) to execute the image forming process for realizing the image forming action corresponding to one pass (S440).

In the image forming process, the main controller 10 commands the printing controller 30 to perform the movement control of the carriage 61 in accordance with the speed profile in the first control mode by inputting the speed profile into the printing controller 30 in the same manner as the process of S130. Further, the main controller 10 inputs, into the printing controller 30, the image data to be formed on the paper Q during the movement course of the carriage 61, and the main controller 10 commands the printing controller 30 to perform the discharging control of the ink in accordance with the image data.

Accordingly, the main controller 10 allows the printing controller 30 to execute the movement control of the carriage 61 in accordance with the first control mode and the ink discharging control in synchronization therewith for realizing the image forming action corresponding to one pass as described above.

Figure 13:
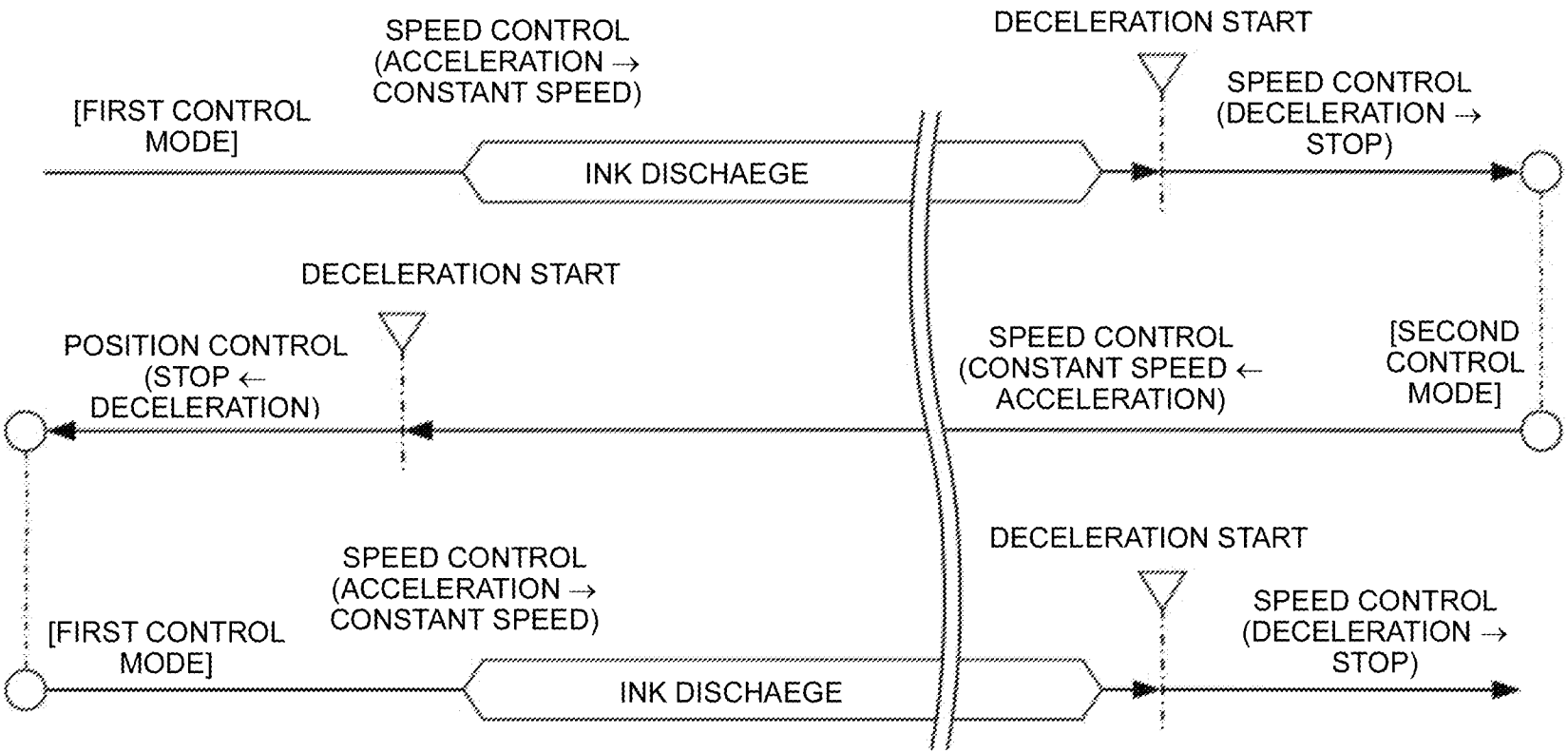
FIG. 13 is an explanatory drawing in relation to a first control mode and a second control mode.
Figure 14:
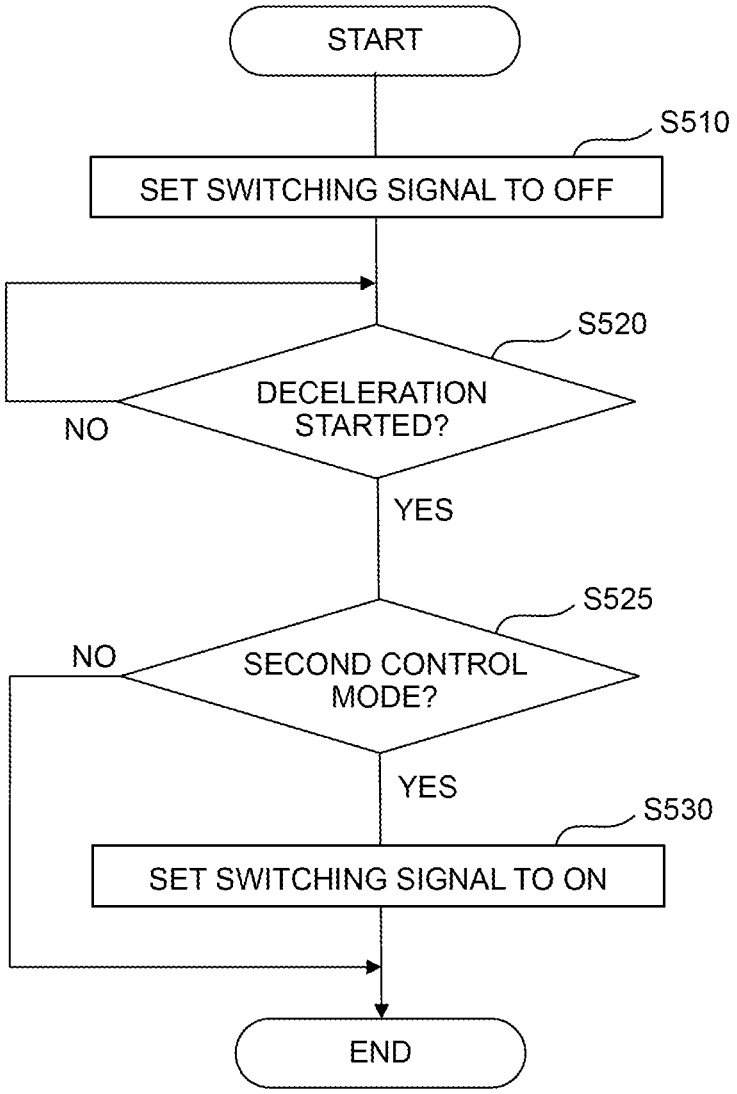
FIG. 14 is a flow chart illustrative of a switching control process.

According to this embodiment, when the printing controller 30 is operated in the first control mode, and the motor controller 100 performs the movement control of the carriage 61 in the outward route, then the motor controller 100 performs the speed control of the carriage 61 not only before the deceleration start but also after the deceleration start as depicted in the upper part of FIG. 13. The maintenance of the speed control before and after the deceleration start is realized by the switching controller 115 by executing the switching control process depicted in FIG. 14 in place of the process depicted in FIG. 7A.

That is, the switching controller 115 sets the switching signal to the OFF signal (S510) so that the operation amount Uv from the speed controller 120 is outputted as the operation amount U for the CR motor 71 upon the start of the movement control in the same manner as the first embodiment.

After that, the switching controller 115 waits until arrival of the deceleration start timing (S520). If the deceleration start timing arrives (Yes in S520), it is determined whether or not the set control mode is the second control mode (S525).

If it is determined that the set control mode is the second control mode (Yes in S525), the switching controller 115 sets the switching signal to the ON signal (S530) so that the operation amount Up from the position controller 140 is outputted as the operation amount U described above. After that, the switching control process is terminated.

On the other hand, if the switching controller 115 determines that the set control mode is not the second control mode but the set control mode is the first control mode (No in S525), the switching controller 115 terminates the switching control process, while retaining the switching signal to the OFF signal.

In this way, in S440, the action to switch the movement control of the carriage 61 to the position control is not executed before stopping the carriage 61 at the target stop position, for the following reason. That is, the image formation on the paper Q, which is performed by discharging the ink, is executed only when the carriage 61 is moved in the outward route, and the image formation is not executed in the homeward route. The ink discharging action is not executed in the course in which the carriage 61 is decelerated to the returning point in the outward route and the carriage 61 is moved to the next returning point in the subsequent homeward route.

In the homeward route, it is unnecessary to control the landing point of the ink accompanied by the movement of the carriage 61, thus it is unnecessary that the stop point of the carriage 61 in the outward route provided just before, which corresponds to the movement start point of the homeward route, should be highly accurately coincident with the target stop position. On this account, in this embodiment, in the movement control process or course in the outward route, the carriage 61 is also subjected to the speed control after the start of the deceleration. That is, the carriage 61 is subjected to the speed control so that the carriage 61 is moved at the constant speed until arrival at the deceleration start point. The carriage 61 is also subjected to the speed control after the deceleration start point so that the carriage 61 is decelerated in accordance with the target speed locus Pv and the carriage 61 stops at the returning point.

When the image forming action corresponding to one pass, which is based on the image forming process (S440), is terminated, the main controller 10 determines whether or not the image forming action corresponding to one page of the paper is completed (S450). If the negative determination is made in this procedure (No in S450), the main controller 10 proceeds to 5460 to execute the homeward route movement process (S470) after switching the control mode of the printing controller 30 to the second control mode.

In the homeward route movement process, the main controller 10 inputs the command into the conveyance controller 40 so that the conveyance control is executed for the paper Q for conveying the paper Q by a predetermined distance downstream in the sub scanning direction, in the same manner as the process of S150.

Further, the main controller 10 commands the printing controller 30 to perform the movement control of the carriage 61 so that the movement direction of the carriage 61 is switched from the forward direction in 5440 to the reverse direction, and the carriage 61 is moved to the movement start point of the carriage 61 for the next image forming action corresponding to one pass (S470).

That is, the main controller 10 generates the speed profile so that the carriage 61 stop at the returning point appropriate for the image forming action corresponding to one pass in the next outward route. The speed profile is inputted into the printing controller 30 together with the target stop position. Thus, the main controller 10 commands the printing controller 30 to perform the movement control of the carriage 61 in accordance with the speed profile.

In the course of the movement control, in the switching controller 115, the switching signal is set to the ON signal at the deceleration start timing in accordance with the affirmative determination in 5525. Accordingly, as depicted in the middle part of FIG. 13, the operation amount Up from the position controller 140 is outputted as the operation amount U for the CR motor 71 at or after the deceleration start point of time, and the carriage 61 is subjected to the position control. That is, the carriage 61 is subjected to the speed control so that the carriage 61 is moved at the constant speed until arrival at the deceleration start point of time. The carriage 61 is subjected to the position control so that the carriage 61 decelerates and stops at the returning point in accordance with the target position locus Px after the deceleration start point of time. In accordance with the position control, the carriage 61 is retained in the state in which the carriage 61 accurately stops at the target stop position.

If the process in 5470 is terminated, the main controller 10 switches the control mode of the printing controller 30 to the first control mode (S430) to execute the image forming process (S440) as depicted in the lower part of FIG. 13.

Then, if the image forming action corresponding to one page of the paper is completed (Yes in S450), then the main controller 10 executes the paper discharge process (S480), and the main controller 10 determines whether or not the image data of the next page is present (S490).

If it is determined that the image data of the next page is present (Yes in S490), the main controller 10 returns the process to 5410 to execute the cueing process for the paper Q. If it is determined that the image data of the next page is absent (No in S490), then the main controller 10 executes the process for moving the carriage 61 to the home position (S500), and the main controller 10 terminates the printing control process.

According to the image forming system 1 of the third embodiment explained above, the movement control process for the carriage 61 in the homeward route has the schedule to execute the image forming action corresponding to one pass in the subsequent outward route. Therefore, the switching is performed from the speed control to the position control when the deceleration is started in accordance with the second control mode. The stop action of the carriage 61 is realized highly accurately in preparation for the next image forming action corresponding to one pass.

In the movement control process in the outward route, there is no schedule to execute the image forming action corresponding to one pass in the subsequent homeward route, and the image formation on the paper Q by discharging the ink is not performed in the subsequent homeward route. Therefore, the switching is not performed to the position control in accordance with the first control mode. The carriage 61 is moved at a high speed to the returning point in accordance with the speed control.

As described above, in this embodiment, in conformity with the execution schedule of the ink discharging action, the switching is performed from the speed control to the position control in the movement control in the homeward route in which the carriage 61 is stopped at the position which serves as the start point of the movement control of the carriage 61 accompanied by the discharging action, and the speed control is maintained without performing the switching in other cases. The switching depending on the situation, as described above, is useful to construct the high performance image forming system 1 in view of the image quality and the throughput. Further, the position control has such a tendency that the motor driving sound is large as compared with the speed control. Therefore, the switching as described above is also useful to reduce the driving sound.

In a modified embodiment, the position controller 140 may be configured such that the value of the speed estimated value V*, which is outputted from the pseudo differentiator 460, is decreased or made to be zero by multiplying the output of the pseudo differentiator 460 by a constant gain after a certain time elapses after the carriage 61 arrives at the target stop position. In accordance with the process as described above, it is possible to decrease the possibility to generate the minute vibration of the carriage 61 resulting from the fluctuation of the speed estimated value V* after the carriage 61 stops at the target stop position.

Other Embodiments

It goes without saying that the present disclosure is not limited to the exemplary embodiments described above, and the present disclosure may take various forms.

For example, the technique of the present disclosure is not limited to the image forming system 1 for forming the image on the sheet-shaped paper Q. The technique of the present disclosure may be applied to a system for forming an image, for example, on a resin sheet or clothes. The technique of the present disclosure may be applied to a system for processing an object by means of any technique other than the ink discharging. Examples of the processing includes, for example, the surface processing for an object other than the image formation and the cutting of an object.

The function as the controller, which is provided to control the movement of the recording head 50 and the carriage 61, is not limited to the combination of the main controller 10 and the printing controller 30, specifically the combination of the processor 11 and ASIC. For example, the movement control of the recording head 50 and the carriage 61 may be realized by means of only the software control performed by one processor or a plurality of processors. In this case, the functions as the printing controller 30 and the conveyance controller 40 may be integrated by the main controller 10. A computer program, which is provided to allow the processor 11 to realize the functions, may be recorded or stored in the memory 13. On the contrary, the movement control of the recording head 50 and the carriage 61 may be realized by means of only the hardware control performed by one ASIC or a plurality of ASIC's.

The function, which is possessed by one constitutive component in the embodiment described above, may be provided in a distributed manner in a plurality of constitutive components. The functions, which are possessed by a plurality of constitutive components, may be integrated by one constitutive component. A part of the configuration of the embodiment described above may be omitted. At least a part of the configuration of the embodiment described above may be subjected to addition or substitution with respect to the configuration of any other embodiment described above. All of the modes, which are included in the technical concept specified by the words recited in claims, encompass embodiments of the present disclosure.

What is claimed is:

1. A control system comprising:

a movement mechanism configured so that the movement mechanism is driven by a motor to move a movable member;

a detector configured to detect a position and a speed of the movable member; and a controller configured to control movement of the movable member by controlling the motor based on the position and the speed of the movable member detected by the detector, wherein:

the controller is configured to:

control the motor so that the movement mechanism reciprocatively moves the movable member; and in a course to move the movable member to a returning point, control the movement of the movable member by controlling the motor based on the speed of the movable member so that the movable member is moved at a constant speed until a deceleration start point of time before the movable member arrives at the returning point, and control the movement of the movable member by controlling the motor based on the position of the movable member so that the movable member is decelerated from the deceleration start point of time and stops at the returning point in accordance with a target position locus, the controlling of the motor based on the position of the movable member being started at the deceleration start point of time.

2. The control system according to claim 1, wherein:

the movable member is configured to process an object in a course of movement; and the controller is configured to:

switch a control mode for the course to move the movable member to the returning point among a plurality of control modes based on an execution schedule of a processing action performed by the movable member;

in a first control mode of the plurality of control modes, control the movement of the movable member by controlling the motor based on the speed of the movable member so that the movable member is moved at the constant speed until the deceleration start point of time, and the movable member is decelerated from the deceleration start point of time and stops at the returning point in accordance with a target speed locus; and in a second control mode of the plurality of control modes, control the movement of the movable member by controlling the motor based on the speed of the movable member so that the movable member is moved at the constant speed until the deceleration start point of time, and control the movement of the movable member by controlling the motor based on the position of the movable member so that the movable member is decelerated from the deceleration start point of time and stops at the returning point in accordance with the target position locus.

3. The control system according to claim 2, wherein in a case that the processing action is not scheduled for a course to move the movable member to a next returning point which follows the course to move the movable member to the returning point, the controller is configured to control the motor in the first control mode in the course to move the movable member to the returning point, and in a case that the processing action is scheduled for the course to move the movable member to the next returning point, the controller is configured to control the motor in the second control mode in the course to move the movable member to the returning point.

4. The control system according to claim 2, wherein the movable member includes a discharge head configured to process a sheet as the object by discharging an ink to form an image on the sheet, and the processing action includes discharging the ink from the discharge head.

5. The control system according to claim 4, wherein the discharge head is configured not to discharge the ink in one of an outward route and a homeward route in the course of the reciprocative movement of the movable member, and is configured to form the image on the sheet by discharging the ink in other one of the outward route and the homeward route in the course of the reciprocative movement of the movable member.

6. The control system according to claim 4, wherein in the second control mode, in a case that the discharging of the ink in a course to move the discharge head to the returning point has been terminated at the deceleration start point of time, the controller is configured to control a position of the discharge head in accordance with the target position locus from the deceleration start point of time, and in a case that the discharging of the ink in the course to move the discharge head to the returning point has not been terminated at the deceleration start point of time, the controller is configured to control a speed of the discharge head so that the discharge head is decelerated in accordance with the target speed locus from the deceleration start point of time and is configured to control the position of the discharge head, after a point of time at which the discharging of the ink is terminated, so that the discharge head is decelerated and stops at the returning point in accordance with the target position locus.

7. The control system according to claim 1, wherein, in a case that the processing action in the course to move the movable member to the returning point has been terminated at the deceleration start point of time, the controller is configured to control the position of the movable member in accordance with the target position locus from the deceleration start point of time, and in a case that the processing action in the course to move the movable member to the returning point has not been terminated at the deceleration start point of time, the controller is configured to control the speed of the movable member so that the movable member is decelerated in accordance with the target speed locus from the deceleration start point of time and is configured to control the position of the movable member, after a point of time at which the processing action is terminated, so that the movable member is decelerated and stops at the returning point in accordance with the target position locus.

8. The control system according to claim 4, wherein the controller is further configured to control the motor so that the movement mechanism moves the discharge head to a capping position and stop the discharge head at the capping position by executing, every time the discharge head is moved by a predetermined amount, such control that a driving electric power for the motor is returned to a reference value and the driving electric power is thereafter increased.

9. The control system according to claim 4, wherein the discharge head is configured to discharge the ink by using an ink supplied via an ink supply tube connected to the discharge head.

10. The control system according to claim 1, wherein in a case that the controller starts the control of the movement of the movable member in accordance with the target position locus, the controller is configured to set an initial value of a target position to a present position of the movable member detected by the detector, and control the position of the movable member in accordance with the target position locus from the initial value.

11. The control system according to claim 2, wherein the controller is configured to control the position of the movable member in accordance with a target position locus in which an initial value of a target position is set to a present position of the movable member detected by the detector when the controller starts the control based on the position of the movable member and which is defined by integrating the target speed locus.

12. The control system according to claim 1, wherein the controller is configured so that:

in a case that the controller controls the movement of the movable member by controlling the motor based on the speed of the movable member, the controller controls the motor based on a deviation between a target speed of the movable member and the speed of the movable member detected by the detector; and in a case that the controller controls the movement of the movable member by in a case that the controller controls the movement of the movable member by controlling the motor based on the position of the movable member, the controller controls the motor based on a deviation between a target position of the movable member and the position of the movable member detected by the detector.

13. A non-transitory and computer-readable medium stored with a program executable by a control system, the control system comprising:

a movement mechanism configured so that the movement mechanism is driven by a motor to move a movable member;

a detector configured to detect a position and a speed of the movable member; and a controller configured to control movement of the movable member by controlling the motor based on the position and the speed of the movable member detected by the detector, wherein:

the program is configured to cause the controller to:

control the motor so that the movement mechanism reciprocatively moves the movable member; and in a course to move the movable member to a returning point, control the movement of the movable member by controlling the motor based on the speed of the movable member so that the movable member is moved at a constant speed until a deceleration start point of time before the movable member arrives at the returning point, and control the movement of the movable member by controlling the motor based on the position of the movable member so that the movable member is decelerated from the deceleration start point of time and stops at the returning point in accordance with a target position locus, the controlling of the motor based on the position of the movable member being started at the deceleration start point of time.

* * * * *